US008079333B2

(12) United States Patent
Choi et al.

(10) Patent No.: US 8,079,333 B2
(45) Date of Patent: Dec. 20, 2011

(54) SLIDE TYPE CONTINUOUS VARIABLE VALVE LIFT DEVICE

(75) Inventors: Byoung Young Choi, Incheon (KR); Dong Heon Park, Hwaseong-si (KR); Sang Hyun Bang, Bucheon-si (KR)

(73) Assignee: Hyundai Motor Company, Seoul (KR)

( * ) Notice: Subject to any disclaimer, the term of this patent is extended or adjusted under 35 U.S.C. 154(b) by 449 days.

(21) Appl. No.: 12/341,819

(22) Filed: Dec. 22, 2008

(65) Prior Publication Data

US 2010/0018484 A1 Jan. 28, 2010

(30) Foreign Application Priority Data

Jul. 23, 2008 (KR) ..... 10-2008-0071695

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39; 74/559, 567, 569
See application file for complete search history.

(56) References Cited

U.S. PATENT DOCUMENTS

| | | | |
|---|---|---|---|
| 6,591,798 | B2 | 7/2003 | Hendriksma et al. |
| 6,745,734 | B2 | 6/2004 | Pierik |
| 7,069,890 | B2 | 7/2006 | Fujita et al. |
| 7,096,835 | B2 | 8/2006 | Fujita et al. |
| 7,168,403 | B2 | 1/2007 | Fujita et al. |

FOREIGN PATENT DOCUMENTS

| | | | |
|---|---|---|---|
| JP | 7-63023 | A | 3/1995 |
| JP | 2001-329816 | A | 11/2001 |

*Primary Examiner* — Ching Chang
(74) *Attorney, Agent, or Firm* — Morgan, Lewis & Bockius LLP

(57) ABSTRACT

A slide type continuous variable valve lift (CVVL) device includes a swing arm rotating to press a valve; a cam lobe; a roller transmitting a driving force of the cam lobe to the swing arm; and a guide guiding the roller to move along a predetermined path. The CVVL device generally can minimize the number of places where sliding friction between respective parts may occur to minimize power loss and enable more precise operation control, reduce the number of parts to enhance the overall robustness of the device, and advance the time of maximum valve opening to improve the fuel efficiency of an engine.

18 Claims, 7 Drawing Sheets

SLIDE TYPE CONTINUOUS VARIABLE VALVE LIFT DEVICE

CROSS-REFERENCE TO RELATED APPLICATION

The present application claims the priority to Korean Patent Application No. 10-2008-0071695 filed Jul. 23, 2008, the entire contents of which application is incorporated herein for all purposes by this reference.

BACKGROUND OF THE INVENTION

1. Field of the Invention

The present invention relates to a slide type continuous variable valve lift device.

2. Description of Related Art

As for an engine, a camshaft is rotated by a rotating force transmitted from a crank shaft, and an intake valve and an exhaust valve are reciprocated up and down with regular timing by cams of the camshaft. Thereby, intake air is supplied to a combustion chamber, and combustion gas is exhausted. In this process, a fuel-air mixture is compressed and exploded to generate power.

At this time, a device that can continuously vary the lift distance of a valve according to an operating speed of the engine is called a continuous variable valve lift (CVVL) device.

Hereinafter, a conventional CVVL device will be described in detail with reference to the attached drawings.

FIG. 1 is a schematic view illustrating the configuration of a conventional CVVL device.

The conventional CVVL device illustrated in FIG. 1 includes a swing arm 30, a cam lobe 40, a frame 50, a rocker arm 60 and a shaft coupler 70. The swing arm 30 is connected to a suction valve 10 and a hydraulic tappet 20 at respective opposite ends thereof, and has a swing arm roller 32 in the middle portion thereof. The cam lobe 40 is provided above the swing arm 30, and the frame 50 is provided to rotate coaxially with the cam lobe 40. The frame 50 has a cam follower 52 protruding out from one portion thereof, wherein a rounded surface 54 is formed in the inner surface of the cam follower 52. The rocker arm 60 is hinged to one portion of the swing arm 30 by a coupler 62, and is provided with a sliding block 66 on the upper end thereof which slides along the rounded surface 54 of the frame 50. The shaft coupler 70 is configured to rotate the frame 50.

A rocker roller 64 is provided on the upper portion of the rocker arm 60, in contact with the outer circumference of the cam lobe 40, and the rocker arm 60 is configured to rotate around the coupler 62 in response to the rotation of the cam lobe 40.

With the above-described configuration, when the cam lobe 40 rotates counterclockwise at the position shown in FIG. 1 so that the tip of the protrusion of the cam lobe 40 comes into contact with the rocker roller 64, the rocker arm 60 rotates clockwise around the coupler 62.

In this case, the center of curvature of the rounded surface 54 is located above the center of rotation of the frame 50. Thus, when the sliding block 66 provided in the upper end of the rocker arm 60 is pulled to the right, the frame 50 rotates in a clockwise direction. As a result, the sliding block 66 comes into contact with the upper portion of the rounded surface 54.

A drive cam 56 is formed in a portion of the frame 50, which comes into contact with the swing arm roller 32. When the frame 50 rotates clockwise at the position shown in FIG. 1, the swing arm 30 is pressed downwards by the drive cam 56 so as to rotate counterclockwise around the end portion connected to the hydraulic tappet 20. Then, the suction valve 10 is moved downwards thereby opening a channel to feed fuel into a cylinder.

Further, when the shaft coupler 70 rotates counterclockwise from the position shown in FIG. 1 thereby causing the frame 50 to rotate clockwise. The sliding block 66 also comes into contact with an upper portion of the rounded surface 54, which is higher than the position shown in FIG. 1. Further, the drive cam 56 is closer to the swing arm 32 than in the position shown in FIG. 1. When the cam lobe 40 rotates from this position to further rotate the frame 50 in a clockwise direction, the drive cam 56 further rotates the swing arm 30 to further increase the lift distance of the suction valve 10.

In other words, the conventional CVVL device shown in FIG. 1 can adjust the lift distance of the suction valve 10 by changing the angle of rotation of the frame 50 before the rocker arm 60 is rotated by the rotation of the cam lobe 40.

However, in the conventional CVVL device described as above, when the swing arm rotates following the rotation of the cam lobe, sliding friction may occurs in at least five places including the contacts between the cam lobe and the frame, between the cam lobe and the rocker roller, between the sliding block and the rounded surface, between the drive cam and the swing arm roller and between the swing arm roller and the swing arm. A large amount of power is lost by friction, and thus precise operation control becomes difficult.

Other problems include increasing the number of springs, which apply an elastic force to respective parts in order to constantly maintain the coupling positions of the respective parts, and increasing loss of friction of the respective parts Furthermore, the friction loss of the respective parts is increased greatly due to the increased number of springs, which apply an elastic force to respective parts to constantly maintain the coupling positions of the respective parts.

Moreover, since the conventional CVVL device is made up of a large number of parts, it is difficult to fabricate the device, manufacturing costs are increased, and the overall robustness of the device becomes lower.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various embodiments of the present invention provide a slide type continuous variable valve lift (CVVL) device that may minimize the number of places where sliding friction between respective parts may occur so as to minimize power loss and enable more precise operation control as well as reduce the number of parts so as to enhance the overall robustness of the device.

In various aspects of the present invention, the slide type CVVL device may include a swing arm rotating to press a valve, a cam lobe, a roller transmitting a driving force of the cam lobe to the swing arm, and/or a guide guiding the roller to move along a predetermined guide path.

The guide may selectively guide the roller to move along both a first path and a second path or only the second path. The roller may intermittently presses the swing arm on the first path but the roller may not press the swing arm on the second path. The cam lobe may be placed above the swing arm. The guide may include a first guide surface extending away from an upper surface of the swing arm to define the first path thereon and a second guide surface extending from a distal end of the first guide surface to the cam lobe to define the second path thereon. The roller may be configured to move in contact with the first guide surface or the second guide surface. The guide may be constructed in such a manner that the first guide surface or the second guide surface comes into contact with the roller according to a rotation angle of the guide.

The guide may be configured to select a path of the roller based on a rotation angle of the guide.

The slide type continuous variable valve lift device may further include a guide control member along which the guide guides the roller. The guide control member may comprise an eccentric cam which rotates the guide.

The guide may be configured to rotate around a rotating shaft which is placed on a predetermined point lower than an upper surface of the swing arm.

The roller may include a substantially cylindrical cam lobe contact and substantially cylindrical swing arm contacts. The swing arm contacts may have a diameter smaller than that of the cylindrical cam lobe contact. The cylindrical swing arm contacts may be provided on opposite ends of the cam lobe contact, respectively. The swing arm may have a through hole, which allows the camp lobe contact to move thereinto. The swing arm may be configured to receive the camp lobe contact.

Various aspects of the present invention are directed to a slide type continuous variable valve lift device may including a swing arm pivotally coupled to a rotating shaft to press a valve, a cam lobe displaced above the swing arm and opposite the rotating shaft of the swing arm, a roller displaced between the swing arm and the cam robe and transmitting a driving force of the cam lobe to the swing arm, a guide coupling the roller and the swing arm and guiding the roller to move along a predetermined path so as to change a distance between the roller and the valve, and/or a guide control member regulating operation of the guide.

The guide control member may control the guide to selectively move the rotation center of the roller to follow both a first path and a second path of the predetermined path or only the second path of the predetermined path. The roller may intermittently presses the swing arm on the first path but does not press the swing arm on the second path.

The guide may include a rotating shaft, a first guide surface extending away substantially in a radial direction from the rotating shaft of the guide to define the first path and a second guide surface extending from a distal end of the first guide surface toward the cam lobe substantially in a circumferential direction to define the second path.

The guide may be configured to select a path of the roller along the predetermined path based on a rotation angle with respect to the rotating shaft of the guide.

The rotating shaft of the guide may be placed or positioned lower than an upper surface of the swing arm. The swing arm may comprise a receiving portion formed at a lower surface thereof to retain the rotating shaft of the guide.

The guide control member may comprise an eccentric cam engaged with the guide and configured to regulate a rotation angle of the guide.

The slide type continuous variable valve lift device may further comprise an elastic member configured to press the roller toward the cam lobe and press the guide toward the guide control member at the same time.

According to various embodiments of the present invention, the CVVL device can reduce the number of places where sliding friction between respective parts may occur to minimize power loss and enable more precise operation control, reduce the number of parts so as to enhance the overall robustness of the device, and advance the time of maximum valve opening so as to improve the fuel efficiency of an engine.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
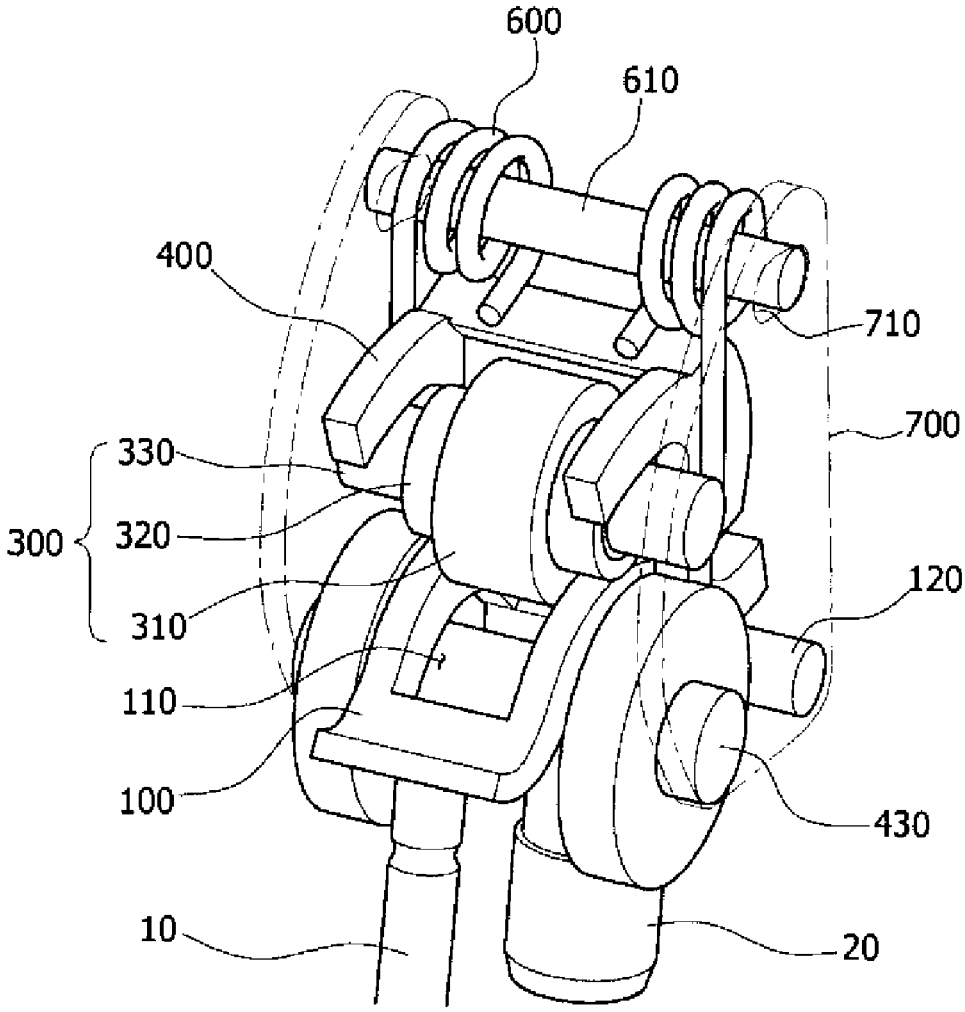
FIG. 2 is a perspective view illustrating an exemplary slide type CVVL device according to the present invention.
Figure 3:
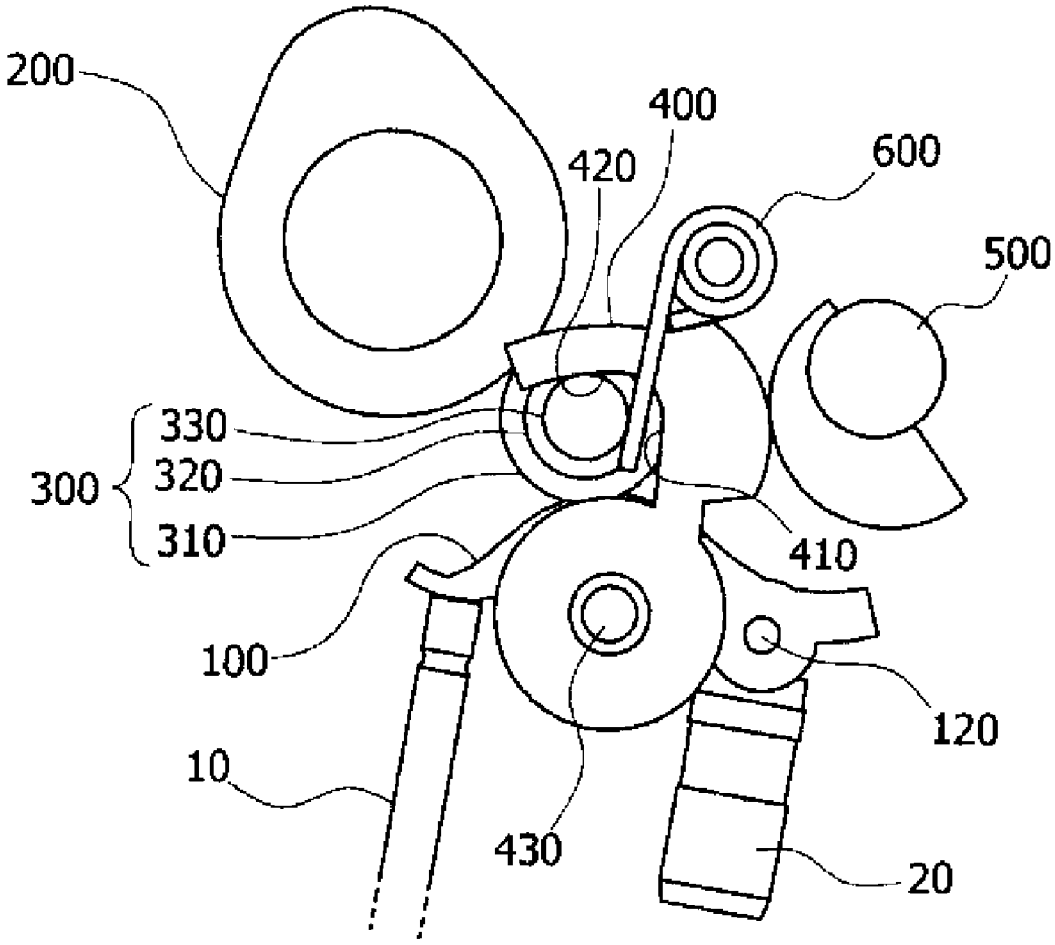
FIG. 3 is a side elevational view illustrating the slide type CVVL device of FIG. 2.
Figure 4:
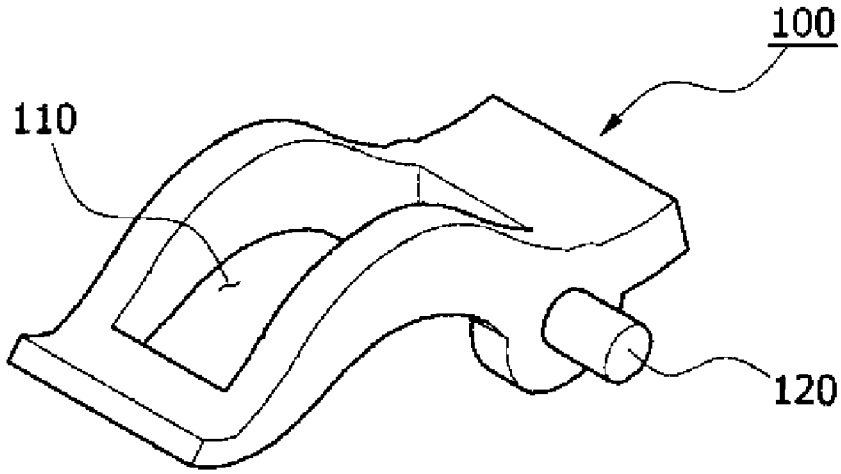
FIG. 4 is a perspective view illustrating a swing arm of the device of FIG. 2.
Figure 5:
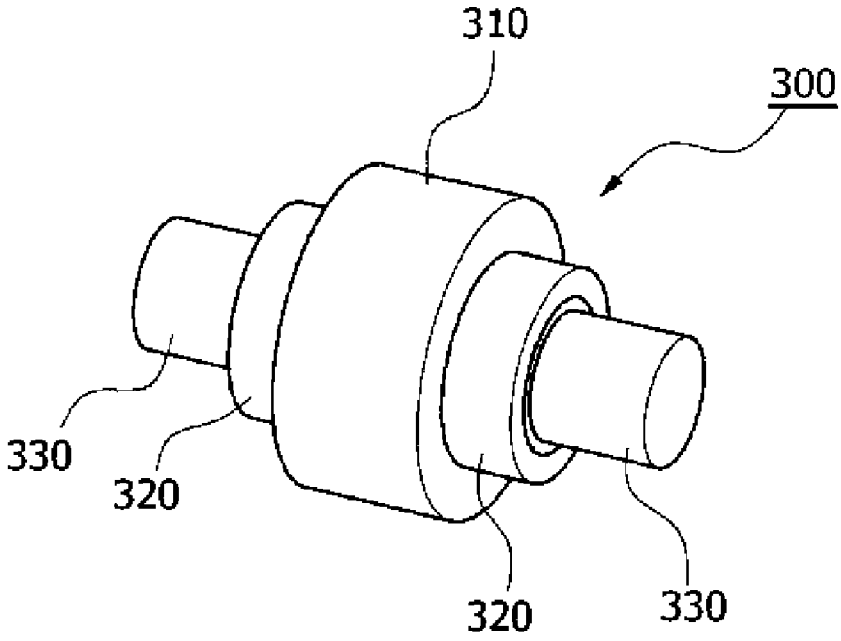
FIG. 5 is a perspective view illustrating a roller of the device of FIG. 2.
Figure 6:
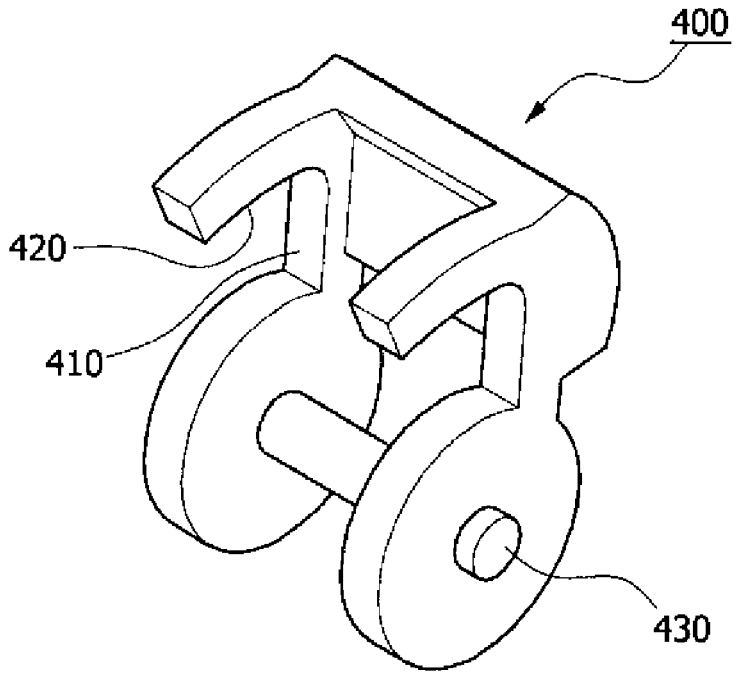
FIG. 6 is a perspective view illustrating a guide of the device of FIG. 2.

FIG. 2 is a perspective view illustrating a slide type CVVL device of the present invention. FIG. 3 is a side elevational view illustrating the slide type CVVL device of the present invention. FIGS. 4-6 are perspective views illustrating a swing arm, a roller and a guide of the slide type CVVL device of the present invention.

As shown in FIGS. 2-6, the slide type CVVL device of the present invention includes a swing arm 100, a cam lobe 200, a roller 300 and a guide 400. The swing arm 100 is connected to a suction valve 10 and a hydraulic tappet 20 at respective opposite ends thereof. The swing arm has a rotating shaft 120 formed in a portion thereof connected to the hydraulic tappet 20.

The swing arm 100 is configured to rotate around the rotating shaft 120 so as to press the suction valve 10. The cam lobe 200 is positioned above the swing arm 100 (e.g. as shown in the upper left part of FIG. 3) to translate or convert the rotation of a camshaft into linear motion. The roller 300 continues to be in contact with the outer circumference of the cam lobe 200. By moving toward the swing arm 100 by the rotation of the cam lobe 200, the roller also presses the swing arm 100. The guide 400 guides the movement of the roller 300. Thus, the roller may transmit movement of the cam lobe to the swing arm. The roller may also translate the movement of the cam lobe to movement of the swing arm in a different direction. Herein, the cam lobe 200 and an eccentric cam 500 are not shown in FIG. 2, but a frame 700 is removed from the view of FIG. 3 to more clearly show the internal construction of the slide type CVVL device of the present invention.

In various embodiments, the slide type CVVL device includes a spring 600 which elastically presses the roller 300 against the cam lobe 200 so the roller 300 can continue to be in constant contact with the cam lobe 200.

The guide 400 is configured to selectively guide the movement of the roller 300 in such a manner that the roller 300 can move along both a first path and a second path of the guide path predetermined by the guide. Alternatively, the guide may select the roller to move along only one of the first path and second path of the guide. The roller 300 intermittently presses the swing arm 100 on the first path, whereas the roller 300 does not press the swing arm 100 on the second path. The guide 400 has a first guide surface 410 extending away from the upper surface of the swing arm 100 (in the first path direction) and a second guide surface 420 extending from the distal end of the first guide surface 410 toward the cam lobe 200 (in the second path direction). Accordingly, in various embodiments, the path is predetermined by the shape and configuration of the first and second guide surfaces. Further, the guide may be configured to guide the roller 300 along both the first and second paths or to guide the roller along only one portion of the first and second paths. Thus, the guide determines whether the predetermined path of the roller includes the first path.

Further, the roller 300 is configured to be pushed by the cam lobe 200 in response to the rotation of the cam lobe 200 thereby moving into contact with the first or second guide surfaces 410 and 420 respectively.

Consequently, the roller 300 presses the swing arm 100 to rotate when moving downwards along the first guide surface 410 but not when moving sideways along the second guide surface 420. The roller 300 does not start to press the swing arm 100 as the cam lobe 200 rotates from the position shown in FIG. 3. Rather, the roller 300 will not press the swing arm 100 when moving along the second guide surface 420 or until starting to move downwards along the first guide surface 410.

The guide 400 is configured to be rotated around a rotating shaft 430 by the eccentric cam 500 which is placed (on the right part of FIG. 3) opposite the cam lobe 200. The spring 600 is constructed not only to press the roller 300 toward the cam lobe 200 but also to press the guide 400 toward the eccentric cam 500 so the guide 400 can continue to be in constant contact with the eccentric cam 500.

In the position shown in FIG. 3, the guide 400 is rotated in a direction moving away from the cam lobe 200 (to the right in FIG. 3) so the roller 300 comes into contact with the second guide surface 420. When the eccentric cam 500 rotates clockwise from the position shown in FIG. 3, the guide 400 rotates in a direction toward the cam lobe 200 (to the left in FIG. 3) so the roller 300 comes into contact with the first guide surface 410. That is, the first guide surface 410 or the second guide surface 420 of the guide 400 comes into contact with the roller 300 based on the angle of rotation of the guide 400.

While the present invention has been described with respect to the eccentric cam 500 as a part for rotating the guide 400 to change the path of the roller 300, as would be understood by one skilled in the art from the foregoing, the eccentric cam 500 can be replaced by any means capable of rotating or moving the guide 400 so that the path of the roller 300 can be changed.

The slide type CVVL device of the present invention can further include the frame 700 to which the rotating shaft 120 and the rotating shaft 430 are rotatably coupled. With the frame 700 additionally provided, the relative distance between the rotating shaft 120 and the guide 400 is kept substantially constant even if the rotating shaft 120 is pushed upwards by operation of the hydraulic tappet 20. In this manner, contact positions of respective parts are kept constant thereby making it possible to more precisely adjust or modify the timing to open. Likewise, the distance to lift the suction valve may also be precisely adjusted. Here, since the spring 600 is wound on a support shaft 610 whose position is fixed, arc holes 710 may be formed in portions of the frame 700 through which the support shaft 610 extends. The center of curvature of the respective arc hole 710 is the same as or positioned at substantially the same point as the center of the rotating shaft 430.

In addition, the rotating shaft 430 of the guide 400, if located at a higher position than the upper surface of the swing arm 100, may interfere with the roller 300 which is moving downwards. In various embodiments, the rotating shaft 430 of the guide 400 is generally located at a lower point than the upper surface of the swing arm 100 during operation.

The roller 300 is a part that continues to be in constant contact with the cam lobe 200 and the guide surfaces 410 and 420 and comes into contact with the swing arm 100 to press the swing arm 100. As shown in FIG. 5, the roller 300 includes a cylindrical cam lobe contact 310. The cylindrical swing arm contacts 320 may have a diameter smaller than that of the cam lobe contact 310. The swing arm contacts 320 may be provided at opposite ends of the cam lobe contact 310, respectively. Also, the cylindrical guide surface contacts 330 may have a diameter smaller than that of the swing arm contacts 320. The guide surface contacts 330 may be provided at outer ends of the swing arm contacts 320 respectively.

The swing arm 100 is formed with a through hole 110 into which the cam lobe contact 310 can be inserted so the swing arm 100 is not pressed downwards by the cam lobe contact 310.

With this construction in which part of the lower portion of the cam lobe contact 310 can be inserted into the through hole 110, the roller 300 can stably press the swing arm 100 without being separated from the swing arm 100 even if for example an external force or vibration is applied.

Figure 7:
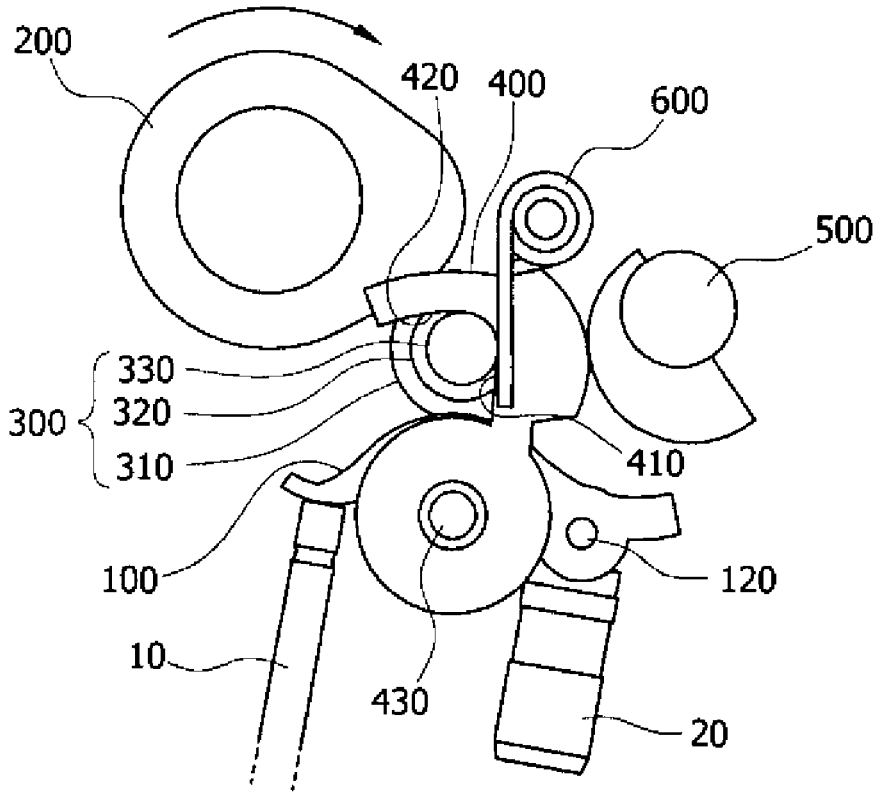
FIGS. 7 and 8 are perspective views illustrating an exemplary operation of a low lift of a slide type CVVL device similar to that of FIG. 2.
Figure 8:
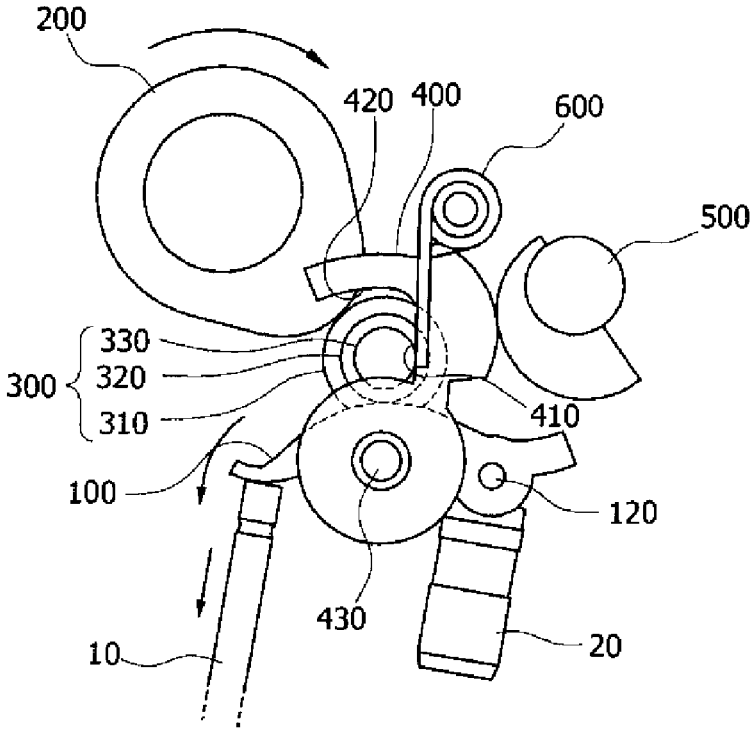

FIGS. 7 and 8 are perspective views illustrating operation of a low lift of the slide type CVVL device according to various embodiments of the present invention.

When the cam lobe 200 rotates clockwise from the position shown in FIG. 3, as shown in FIG. 7, the tip of the protrusion of the cam lobe 200 approaches the roller 300 and thus the roller 300 is pushed to the right along the second guide surface 420 toward the first guide surface 410. While the roller 300 moves along the second guide surface 420, the swing arm 100 is not pressed and thus does not open the suction valve 10.

When the cam lobe 200 further rotates clockwise from the position shown in FIG. 7, the roller 300 further moves downwards along the first guide surface 410, thereby pressing the swing arm 100 as shown in FIG. 8. The swing arm 100, when pressed downwards as described above, rotates counterclockwise around the rotating shaft 120 to open the suction valve 10.

That is, the operation shown in FIGS. 7 and 8 is a low lift operation in which the suction valve 10 is not opened as soon as the tip of the protrusion of the cam lobe 200 contacts the roller 300. Instead, it is opened only after a predetermined time from the time of contact.

Figure 9:
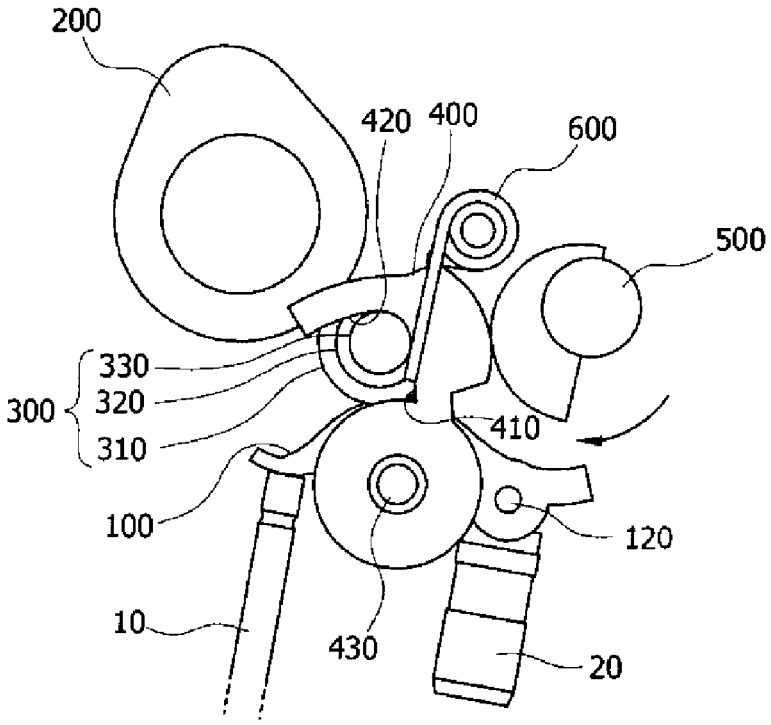
FIGS. 9 and 10 are perspective views illustrating an exemplary operation of a low lift of a slide type CVVL device similar to that of FIG. 2.
Figure 10:
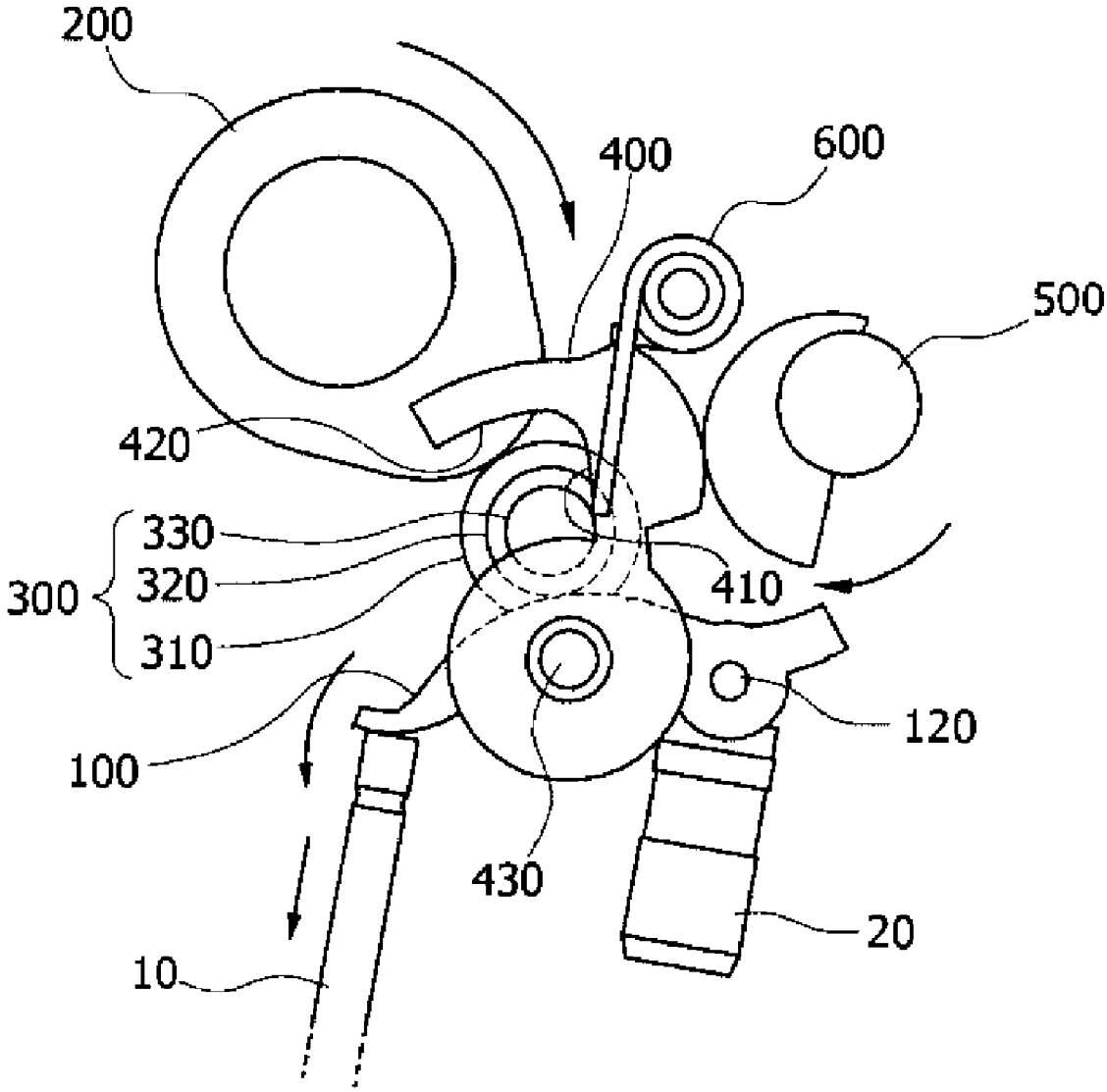

FIGS. 9 and 10 are perspective views illustrating an example of the operation of a high lift of the slide type CVVL device according to various embodiments of the present invention.

When the eccentric cam 500 rotates clockwise from the position shown in FIG. 3, the guide 400 is pushed by the eccentric cam 500 to rotate counterclockwise around the rotating shaft 430. As shown in FIG. 9, the first guide surface 410 comes into contact with the roller 300.

In this position where the roller 300 is in contact with the first guide surface 410, the roller 300 moves downwards as soon as the cam lobe 200 rotates. Thus, the suction valve 10 is opened more quickly than the case shown in FIGS. 7 and 8. When the tip of the protrusion of the cam lobe 200 is in contact with the roller 300, the swing arm 100 rotates more and thus the suction valve 10 is opened more than in the case shown in FIG. 8.

That is, the operation shown in FIGS. 9 and 10 is a high lift operation in which the suction valve 10 is opened as soon as the tip of the protrusion of the cam lobe 200 comes into contact with the roller 300.

Figure 1:
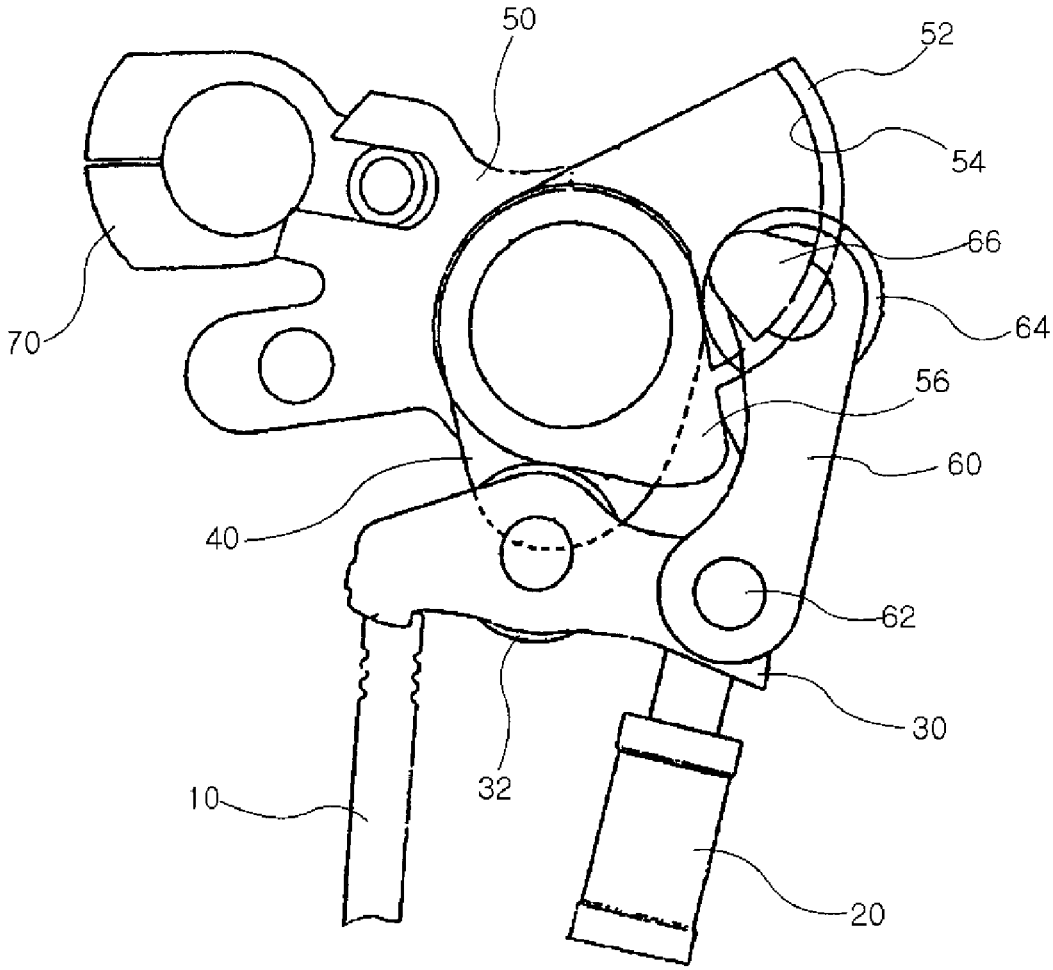
Fig.1 (Prior Art)
FIG. 1 is a side elevational view illustrating a continuous variable valve lift (CVVL) device of the related art.

As described above, the slide type CVVL device of the present invention can continuously vary the lift distance of the suction valve 10 using a smaller number of parts than the conventional CVVL device shown in FIG. 1.

Accordingly, the slide type CVVL device of the present invention leads to a simpler construction and causes to reduce the number of places where parts are pressed and abraded against each other thereby improving the overall strength of the device.

Furthermore, the low lift state shown in FIG. 8 is advanced compared to the high lift state shown in FIG. 10. In the low lift state shown in FIG. 8, the roller 300 is located opposite to the direction of rotation of the cam lobe 200. Thus the time to open the suction valve to a greatest or maximum amount is advanced. The slide type CVVL device of the present invention can improve the fuel efficiency of an engine by advancing the time of maximum valve opening within about 20 degrees in the transition from the high lift state to the low lift state.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A slide type continuous variable valve lift device comprising:

a swing arm rotating to press a valve;

a cam lobe;

a roller transmitting a driving force of the cam lobe to the swing arm; and a guide guiding the roller to move along a predetermined path;

wherein the guide selectively guides the roller to move along both a first path and a second path or only the second path, wherein the roller intermittently presses the swing arm on the first path but does not press the swing arm on the second path.

2. The slide type continuous variable valve lift device of claim 1, wherein the cam lobe is positioned above the swing arm, further wherein the guide includes a first guide surface extending away from an upper surface of the swing arm to define the first path and a second guide surface extending from a distal end of the first guide surface to the cam lobe to define the second path, and further wherein the roller is configured to selectively contact the first guide surface or the second guide surface.

3. The slide type continuous variable valve lift device of claim 2, wherein the guide is constructed in such a manner that the first guide surface or the second guide surface comes contacts the roller based on a rotation angle of the guide.

4. The slide type continuous variable valve lift device of claim 1, wherein the guide is configured to select a path of the roller based on a rotation angle of the guide.

5. The slide type continuous variable valve lift device of claim 1, further comprising a guide control member along which the guide guides the roller.

6. The slide type continuous variable valve lift device of claim 5, wherein the guide control member comprises an eccentric cam, the eccentric cam being configured to rotate the guide.

7. The slide type continuous variable valve lift device of claim 1, wherein the guide is configured to rotate around at least a portion of a rotating shaft, the shaft being positioned at a predetermined point lower than an upper surface of the swing arm.

8. An engine comprising the slide type continuous variable valve lift device of claim 1.

9. A slide type continuous variable valve lift device comprising:

a swing arm rotating to press a valve;

a cam lobe;

a roller transmitting a driving force of the cam lobe to the swing arm; and a guide guiding the roller to move along a predetermined path;

wherein the roller includes a substantially cylindrical cam lobe contact and substantially cylindrical swing arm contacts, the swing arm contacts having a diameter smaller than that of the cam lobe contact, the swing arm contacts provided on opposite ends of the cam lobe contact respectively, and wherein the swing arm has a through hole configured to receive the cam lobe contact.

10. A slide type continuous variable valve lift device comprising:

a swing arm pivotally coupled to a rotating shaft to press a valve;

a cam lobe displaced above the swing arm and opposite the rotating shaft of the swing arm;

a roller displaced between the swing arm and the cam robe and configured to transmit movement of the cam lobe to the swing arm;

a guide coupling the roller and the swing arm and guiding the roller along a guide path so as to change a distance between the roller and the valve; and a guide control member configured to control the guide;

wherein the guide control member controls the guide to modify a rotational center of the roller to follow either a first path and a second path of the guide path or only the second path of the guide path, wherein the roller intermittently presses the swing arm on the first path but does not press the swing arm on the second path.

11. The slide type continuous variable valve lift device of claim 10, wherein the guide includes:

a rotatable shaft;

a first guide surface extending away from the shaft substantially in a radial direction, the first guide surface defining the first path, and a second guide surface extending from a distal end of the first guide surface toward the cam lobe substantially in a circumferential direction, the second guide surface defining the second path.

12. The slide type continuous variable valve lift device of claim 11, wherein the guide is configured to select a path of the roller along the guide path based on a rotation angle with respect to the rotating shaft of the guide.

13. The slide type continuous variable valve lift device of claim 11, wherein the rotating shaft is positioned lower than an upper surface of the swing arm.

14. The slide type continuous variable valve lift device of claim 13, wherein the swing arm comprises a receiving portion formed at a lower surface thereof to retain the rotating shaft.

15. The slide type continuous variable valve lift device of claim 10, further comprising an elastic member configured to press the roller toward the cam lobe and press the guide toward the guide control member substantially simultaneously.

16. An engine comprising the slide type continuous variable valve lift device of claim 10.

17. A slide type continuous variable valve lift device comprising:

a swing arm pivotally coupled to a rotating shaft to press a valve;

a cam lobe displaced above the swing arm and opposite the rotating shaft of the swing arm;

a roller displaced between the swing arm and the cam robe and configured to transmit movement of the cam lobe to the swing arm;

a guide coupling the roller and the swing arm and guiding the roller along a guide path so as to change a distance between the roller and the valve; and a guide control member configured to control the guide;

wherein the guide control member comprises an eccentric cam engaged with the guide and configured to modify the rotation angle of the guide.

18. A slide type continuous variable valve lift device comprising:

a swing arm pivotally coupled to a rotating shaft to press a valve;

a cam lobe displaced above the swing arm and opposite the rotating shaft of the swing arm;

a roller displaced between the swing arm and the cam robe and configured to transmit movement of the cam lobe to the swing arm;

a guide coupling the roller and the swing arm and guiding the roller along a guide path so as to change a distance between the roller and the valve; and a guide control member configured to control the guide;

wherein the roller includes a substantially cylindrical cam lobe contact and substantially cylindrical swing arm contacts, the swing arm contacts having a diameter smaller than the cylindrical cam lobe contact, the cylindrical swing arm contacts provided on opposite ends of the cam lobe contact respectively, and wherein the swing arm has a through hole configured to receive the camp lobe contact.

* * * * *